US006719340B2

(12) United States Patent
Imig

(10) Patent No.: US 6,719,340 B2
(45) Date of Patent: Apr. 13, 2004

(54) PUCK RETRIEVER AND CARRIER

(76) Inventor: Douglas R. Imig, 25 Heritage Woods Pl., Allen, TX (US) 75002

( * ) Notice: Subject to any disclaimer, the term of this patent is extended or adjusted under 35 U.S.C. 154(b) by 0 days.

(21) Appl. No.: 09/794,274

(22) Filed: Feb. 27, 2001

(65) Prior Publication Data

US 2002/0130523 A1 Sep. 19, 2002

(51) Int. Cl.[7] ..... A63B 47/02; A63B 69/40
(52) U.S. Cl. ..... 294/19.2; 473/446
(58) Field of Search ..... 294/19.2; 56/332; 473/446, 460, 471, 588

(56) References Cited

U.S. PATENT DOCUMENTS

| | | | | | |
|---|---|---|---|---|---|
| 492,824 | A | * | 3/1893 | McLean | 294/19.2 |
| 2,760,807 | A | * | 8/1956 | Watson | 294/19.2 |
| 3,665,910 | A | * | 5/1972 | Boni | 124/73 |
| 3,876,201 | A | * | 4/1975 | King | 124/4 |
| 3,901,545 | A | * | 8/1975 | Shott | 294/19.2 |
| 4,045,068 | A | | 8/1977 | Nelson | 294/19.2 |
| 4,058,336 | A | | 11/1977 | Parkinson | 294/19.2 |
| 4,063,769 | A | | 12/1977 | Zimmer | 294/19.2 |
| 4,398,716 | A | * | 8/1983 | Argibay, Jr. et al. | 221/194 |
| 4,522,438 | A | | 6/1985 | Logue | 294/19.2 |
| 4,811,980 | A | | 3/1989 | Ferrari et al. | 294/19.2 |
| 5,060,996 | A | * | 10/1991 | Garnes | 221/309 |
| 5,069,451 | A | * | 12/1991 | Martens et al. | 124/47 |
| 5,306,000 | A | * | 4/1994 | Comella | 294/19.2 |
| 5,395,146 | A | | 3/1995 | Liu et al. | 294/19.2 |
| 5,505,510 | A | | 4/1996 | Duncan | 294/19.2 |
| 5,634,680 | A | * | 6/1997 | Green | 206/315.9 |
| 5,639,133 | A | | 6/1997 | Mote | 294/19.2 |
| 5,857,451 | A | * | 1/1999 | Ciluffo et al. | 124/6 |
| D411,278 | S | | 6/1999 | Sammons et al. | D21/796 |

FOREIGN PATENT DOCUMENTS

| | | | | |
|---|---|---|---|---|
| GB | 10601 | * | 2/1902 | 294/19.2 |

OTHER PUBLICATIONS

Porta–Puck, http://www.boni.com/models/porta.html; Dated Feb. 13, 2001; (2 pp.).

* cited by examiner

*Primary Examiner*—Dean J. Kramer
(74) *Attorney, Agent, or Firm*—Gardere Wynne Sewell LLP; Kenneth T. Emanuelson

(57) ABSTRACT

The present invention relates to sporting goods, and in particular to a device for retrieving hockey pucks. The device makes use of an array of retaining whiskers at the open end of the device to capture and retain hockey pucks. The design of the whisker array is such that the whiskers can suspend a large number of hockey pucks against the force of gravity while at the same time allowing for new pucks to be captured by the device with a minimum of downward pressure. One embodiment of the present invention is a puck shooting device incorporating one or more of the puck retrieval devices in a removable arrangement as a puck feed magazine for the puck shooter.

10 Claims, 2 Drawing Sheets

PUCK RETRIEVER AND CARRIER

TECHNICAL FIELD OF THE INVENTION

The invention relates in general to the field of sporting goods, and in particular, to devices and apparatus for retrieving hockey pucks.

BACKGROUND OF THE INVENTION

In many sports, players use a large number of balls in practice. In baseball, for example, a batter practicing his hitting on the field may make use of a basketful of practice balls, in order that he does not have to stop between each practice swing to chase down the ball. Tennis and golf are two other examples of sports making use of a number of balls during practice.

Efficient retrieval of the balls for reuse during practice is important in order to minimize the time wasted and maximize the time available for practice. Devices of various construction suitable for retrieving balls used in sports are known to those of skill in the art. One well-known design, for example, is a basket having a heavy gauge wire grid on its base to capture flexible balls such as tennis balls. The spacing of the grid is such that the balls flex and compress between the wire segments and into the basket as the grid is forceably pressed down over the balls.

Other devices employ tubular structures for this application. In these designs, there is a "keeper" of some type at the end of the entry end of the device. In a similar manner to that described above with respect to the wire basket design, the device is employed by pressing the entry end of the device down over the ball to be retrieved. For devices designed to retrieve soft or flexible balls, the keeper structure can be rigid. For devices designed to retrieve hard balls, the keeper is generally flexible.

Examples of devices designed for retrieving hard balls are disclosed in U.S. Pat. No. D411,278 to Sammons; U.S. Pat. No. 5,395,146 to Liu; U.S. Pat. No. 4,063,769 to Zimmer; and U.S. Pat. No. 4,058,336 to Parkinson. Examples of devices designed for retrieving soft or flexible balls are disclosed in U.S. Pat. No. 4,811,980 to Ferrari; U.S. Pat. No. 4,522,438 to Logue; and U.S. Pat. No. 4,045,068 to Nelson. Examples of devices suitable for either type of balls are disclosed in U.S. Pat. No. U.S. Pat. No. 5,639,133 to Mote and U.S. Pat. No. 5,505,510 to Duncan.

In general, the above-referenced devices make use of either separate keeper mechanisms or integral keeper features to capture and retain the balls. In certain cases, the keepers are formed as part of the main retrieval structure, for example as detents formed in the sidewall of a straight tube. Other designs make use of flexible retaining tabs disposed around the entry portion of the device.

Although the various retaining structures incorporated into prior designs have been found suitable for capture and retention of hollow spherical shapes, it has been found that the retaining structures traditionally used for the capture and retention of balls are not suitable for the capture and retention of non-spherical objects, particularly those objects having a solid, rather than hollow, construction.

For this reason outlined above, there remains a need for a retrieval device suitable for picking up non-spherical objects. In particular, there is a need for a device suitable for capturing and retaining cylindrical objects.

SUMMARY OF THE INVENTION

The device of the present invention incorporates an improved object retention structure to allow the device to capture and retain non-spherical objects, in particular, hockey pucks.

Hockey pucks have a significantly different structure than sports balls. While most sports balls are substantially hollow and are therefore generally lightweight, hockey pucks are solid rubber, and are therefore heavier than most balls. Whereas balls have a curved surface and a varying cross-section facilitating capture by a detent mechanism, hockey pucks are cylindrical and have an essentially constant cross-section along their vertical axis, making capture by a single capture mechanism much more difficult.

While balls stack inefficiently in a tube, with significant air space surrounding them, hockey pucks stack extremely efficiently. As such, a tube full of hockey pucks will be much heavier than a tube full of balls of the same diameter and density, placing greater load on the retention features at the entry. Finally, while many balls have a relatively smooth surface, allowing them to slide past retention structures relatively easily, hockey pucks have a roughened rubber surface, making sliding motion difficult.

In order to address the above difficulties, the present invention makes use of a novel multi-fingered retention structure to enable the capture and retention of hockey pucks and similar structures.

In one embodiment, the present invention is a puck retrieval device comprising a puck receiving tube, a puck retainer attached to one end of the puck receiving tube and having an inside surface, and two or more puck retaining structures disposed on the inside surface of the puck retainer in a substantially regular pattern, such that a puck entering the puck retainer will be securely captured by the retaining structure.

In another embodiment, the present invention is a puck shooting device incorporating a puck shooting mechanism, a puck receiving tube removably attached to the puck shooting mechanism in such a manner to feed the puck shooting mechanism with pucks, a puck retainer attached to one end of the puck receiving tube and having an inside surface, and two or more puck retaining structures disposed on the inside surface of the puck retainer in a substantially regular pattern, such that a puck entering the puck retainer will be securely captured by the retaining structure.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

While the making and using of various embodiments of the present invention are discussed in detail below with reference to hockey pucks, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

As discussed above, a number of devices of various construction have been developed to facilitate the collection of balls used in sports are known to those of skill in the art. One well-known design of such a device is a basket having a heavy gauge wire grid on its base to capture flexible balls such as tennis balls. In general, prior ball-retrieval devices make use of either separate keeper mechanisms or integral keeper structures to capture and retain the balls. In certain cases, the keepers are formed as part of the main retrieval structure, for example as detents formed in the sidewall of a straight tube. Other designs make use of flexible retaining tabs disposed around the entry portion of the device.

Although the various retaining structures incorporated into prior designs have been found suitable for capture and retention of hollow spherical shapes, it has been found that the retaining structures traditionally used for the capture and retention of balls are not suitable for the capture and retention of non-spherical objects, particularly those objects having a solid, rather than hollow, construction.

Hockey pucks have a significantly different structure than balls. While most sports balls are substantially hollow and therefore generally lightweight, hockey pucks are solid rubber, and therefore heavier than balls. Whereas balls have a curved surface and a varying cross-section facilitating capture by a detent mechanism, hockey pucks are cylindrical and have an essentially constant cross-section along their vertical axis, making capture by a single capture mechanism much more difficult.

While balls stack inefficiently in a tube, with significant air space surrounding them, hockey pucks stack extremely efficiently. As such, a tube full of hockey pucks will be much heavier than a tube full of balls of the same diameter and density, placing greater load on the retention features at the entry. Finally, while many balls have a relatively smooth surface, allowing them to slide past retention structures relatively easily, hockey pucks have a roughened rubber surface, making sliding motion difficult.

In order to address the above difficulties, the present invention makes use of a novel multi-fingered retention structure to enable the capture and retention of hockey pucks and similar structures.

Figure 1:
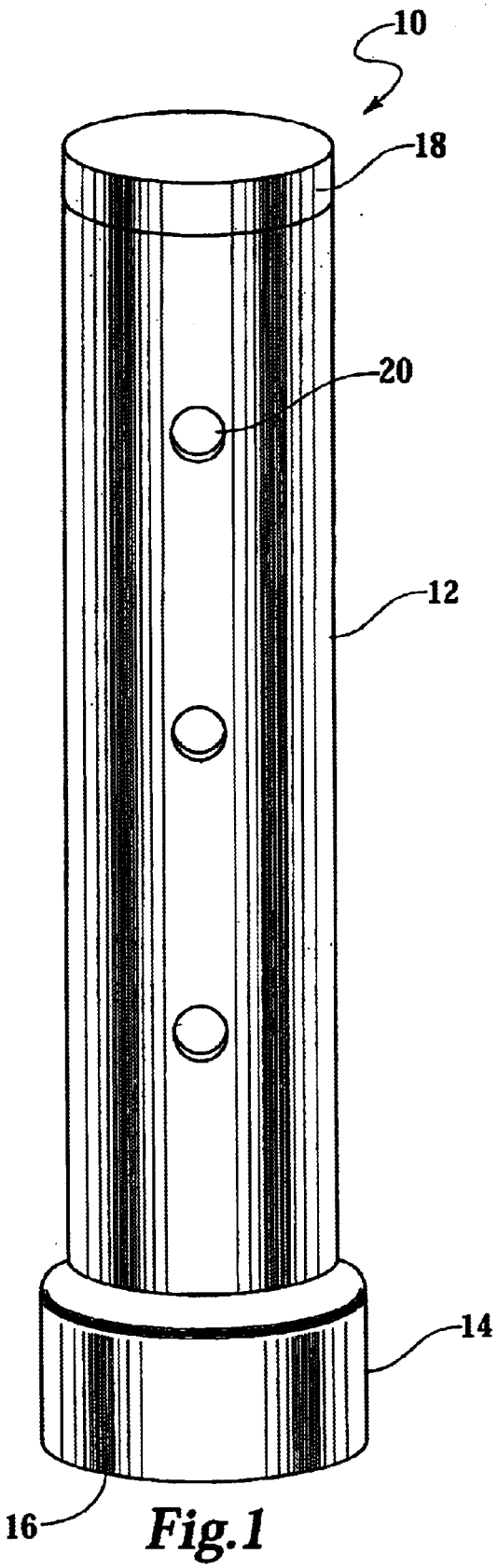
FIG. 1 is an elevation view of a puck retrieval device according to one embodiment of the present invention.

FIG. 1 shows a puck retriever according to one embodiment of the present invention, generally designated 10. Puck retriever 10 includes main tube 12 and retainer 14. In various embodiments, main tube 12 may be constructed of any of a variety of materials, including plastic, metal, or composite material. Depending on the material, main tube 12 may be opaque, translucent, or transparent. Retainer 14 may have any one of a variety of constructions suitable for retaining cylindrical objects, as described below.

Puck retriever 10 may also incorporate a cap 18. Cap 18 is opened or removed from the top of main tube 12 when the main tube 12 is to be emptied of pucks. Main tube 12 may have holes or slots 20 in it, so as to allow the user to easily ascertain the quantity of pucks within the main tube 12. Main tube 12 may have a handle (not shown) attached thereto.

In use, puck retriever 10 is lowered over a puck to be retrieved. The puck will then be situated at the entry 16 of retainer 14. In certain embodiments, puck retriever 10 must be pressed down over the puck in order to force the puck through the entry 16 and into retainer 14. The puck will then be captured securely by the retainer 14. With the puck securely captured by the retainer 14, the puck retriever 10 can then be moved into place over another puck. A number of pucks can be retrieved in sequence in this manner, until main tube 12 is full.

The retention capability of retainer 14 must be sufficient to hold the weight of the puck within the retainer 14 as well as the total weight of the pucks resting above that puck. As the main tube 12 fills up with pucks, this weight becomes considerable. As mentioned above, the weight of a main tube 12 full of cylindrical pucks is considerably higher than the weight of a main tube 12 full of spherical balls, owing to the much higher packing efficiency of the cylindrical objects. Accordingly, the performance requirements of retainer 14 are much higher than the performance requirements for prior art designs developed for the retention of cylindrical shapes.

In addition to the above, while most sports balls are substantially hollow and therefore generally lightweight, hockey pucks are solid rubber, and therefore heavier than balls. This fact exacerbates the loading on the retainer 14, which is already increased due to the above-described increase in stacking efficiency.

Furthermore, whereas balls have a curved surface and a varying cross-section facilitating capture by a detent mechanism, hockey pucks are cylindrical and have an essentially constant cross-section along their vertical axis, making capture by a single capture mechanism much more difficult. In other words, there is no feature on the side of a hockey puck corresponding to the lower hemisphere of a ball, which ball retention devices use for ball capture. Accordingly, hockey pucks must be captured by some other scheme.

Finally, while many balls have a relatively smooth surface, allowing them to slide past retention structures relatively easily, hockey pucks have a roughened rubber surface, making sliding motion difficult. Accordingly, retention mechanisms suitable for capturing hockey pucks must have reduced sliding friction in the upward direction, so that the downward force required of the user is minimized.

Figure 2:
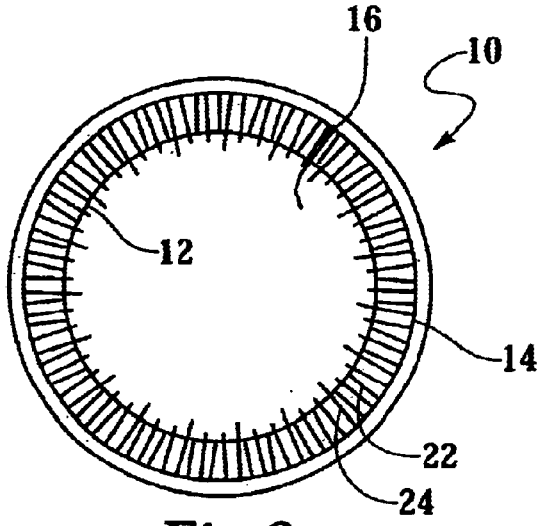
FIG. 2 is an end view of the entry portion of a puck retrieval device according to one embodiment of the present invention.

FIG. 2 is an end view of the entry 16 of a puck retriever 10 according to one embodiment of the present invention. In this view, the construction of the retainer 14 can be clearly seen. Retainer 14 is a tubular section having an array of whiskers, such as whiskers 22 and 24, disposed about the periphery. In the embodiment shown in FIG. 2, the whiskers 22 and 24 are disposed uniformly around the periphery of retainer 14, though other geometries are possible. For example, whiskers 22 and 24 could be disposed in two or more patches about the periphery. In the embodiment shown in FIG. 2, the retainer 14 has a larger outside diameter than main tube 12 and the whiskers 22 and 24 extend in past the edge of main tube 12.

Whiskers 22 and 24 may be made of any suitable material, as will be apparent to one of skill in the art, including polymers, elastomers, metals, and composites. In the embodiment shown in FIG. 2, it can be seen that whiskers 22 and 24 vary in length. This variance can provide the proper holding force while allowing for acceptable downforce characteristics. In varying embodiments, the diameter, as well as the material, of whiskers 22 and 24 may also vary to adjust the characteristics of retainer 14. Whiskers 22 and 24 may have a low-friction material, such as PTFE, deposited on their lower edge to reduce downforce. The tips of whiskers 22 and 24 may be shaped to allow the puck to pass upward through the retainer 14, but not downward.

Figure 3:
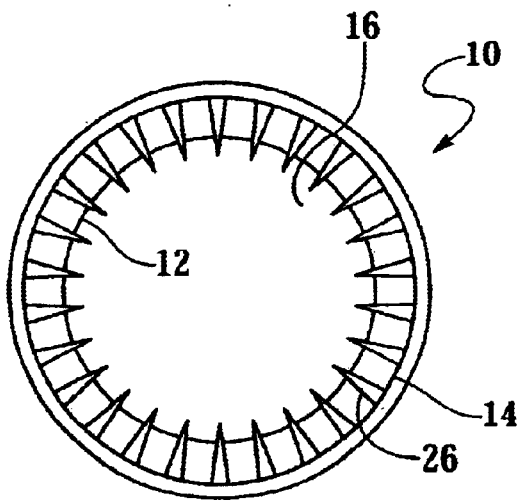
FIG. 3 is an end view of the entry portion of a puck retrieval device according to a second embodiment of the present invention.

FIG. 3 is an end view of the entry 16 of a puck retriever 10 according to a second embodiment of the present invention. Retainer 14 is a tubular section having an array of cones 26 disposed about the periphery. In the embodiment shown in FIG. 2, the cones 26 are disposed evenly around the periphery of retainer 14, though other geometries are possible. For example, cones 26 could be disposed in two or more patches about the periphery. In the embodiment shown in FIG. 2, the retainer 14 has a larger outside diameter than main tube 12 and the cones 26 extend in past the edge of main tube 12.

Cones 26 may be made of any suitable material, as will be apparent to one of skill in the art, including polymers, elastomers, metals, and composites. In varying embodiments, the length, diameter, and material of cones 26 may vary to adjust the characteristics of retainer 14. Cones 26 may have a low-friction material, such as PTFE, deposited on their lower edge to reduce downforce requirements. The tips of cones 26 may be shaped to allow the puck to pass upward through the retainer 14, but not downward.

Figure 4:
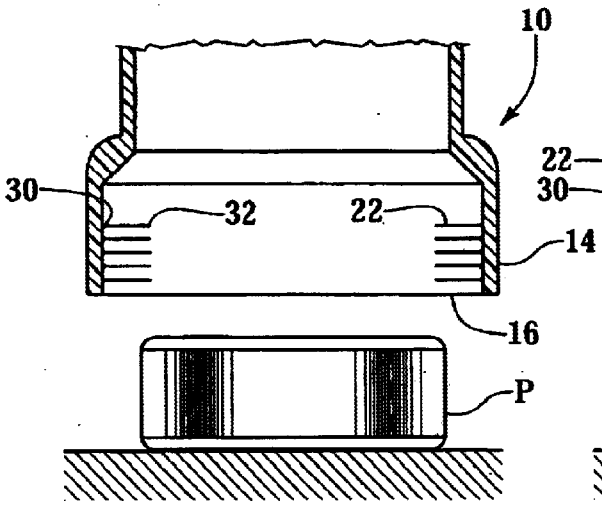
FIG. 4 is a cut-away view of the entry portion of a puck retrieval device according to one embodiment of the present invention.

FIG. 4 is a cut-away side view of the retainer 14 of a puck retriever 10 according to one embodiment of the present invention as it is being lowered over a puck P. Retainer 14 incorporates an array of whiskers 22 about its periphery. Each of whiskers 22 has a base 30 and a tip 32. In the embodiment shown in FIG. 4, whiskers 22 are arranged in five rows as an illustration, but one of skill in the art will understand that more or fewer rows may be used in other designs without departing from the spirit and scope of the present invention. In fact, there is nothing within the spirit and scope of the present invention necessitating the arrangement of whiskers 22 in regular rows.

In the embodiment shown in FIG. 4, whiskers 22 are shown extending straight and parallel to one another and perpendicular to the sidewall of retainer 14. There is nothing within the spirit and scope of the present invention necessitating such an arrangement. Other embodiments may include, for example, whiskers 22 angled or curved upwardly from entry 16 to help guide the puck P into the retainer 14.

Whiskers 22 are secured to the inner wall of retainer 14 at bases 30. Bases 30 may be secured to the inner wall of retainer 14 by adhesive or may be thermally welded, as examples. In certain embodiments, whiskers 22 may be made of a different material than bases 30. In such embodiments, whiskers 22 may be more or less flexible than bases 30, such that the flexing of whiskers 22 may take place primarily in the main shafts of the whiskers 22, in the bases 30, or equally in both. Any of these arrangements is within the spirit and scope of the present invention, so long as the whiskers 22 are allowed to flex in a sufficient degree to allow for the entry of puck P without undue downforce required of the user.

Figure 5:
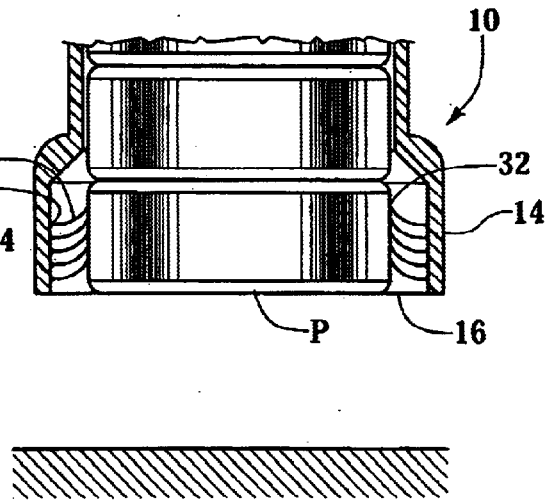
FIG. 5 is a cut-away view of the entry portion of a puck retrieval device according to one embodiment of the present invention.

FIG. 5 is a cut-away side view of the retainer 14 of a puck retriever 10 after capture of a puck P. As shown in FIG. 5, puck P is retained within retainer 14 against the force of gravity by the ends 32 of whiskers 22. In this embodiment, the bases 30 of whiskers 22 are rigid in comparison to the whiskers 22 themselves, so that flexure and displacement is accommodated by the whiskers themselves. As discussed above, alternate embodiments may employ rigid whiskers 22 working in combination with flexible bases 30 to the same effect.

As shown in FIG. 5, puck P is wedged in between the opposing sets of whiskers 22. In this position, puck P cannot pass out of the opening 16 of retainer 14 without displacing whiskers 22 to some degree, as there will be some friction between the ends 32 of the whiskers and the sides of the puck P. If there is sufficient friction between the ends 32 of the whiskers 22 and the sides of the puck P, the capturing action of the whiskers 22 will be "self-energizing," such that an increase in the downward force on the puck P will increase the frictional holding force applied by the ends 32 of the whiskers 22. With this arrangement, puck P cannot pass downward against the holding force of the whiskers 22 without buckling the whiskers 22 themselves. This arrangement allows for an increasing puck holding force as the device 10 fills with pucks.

Figure 6:
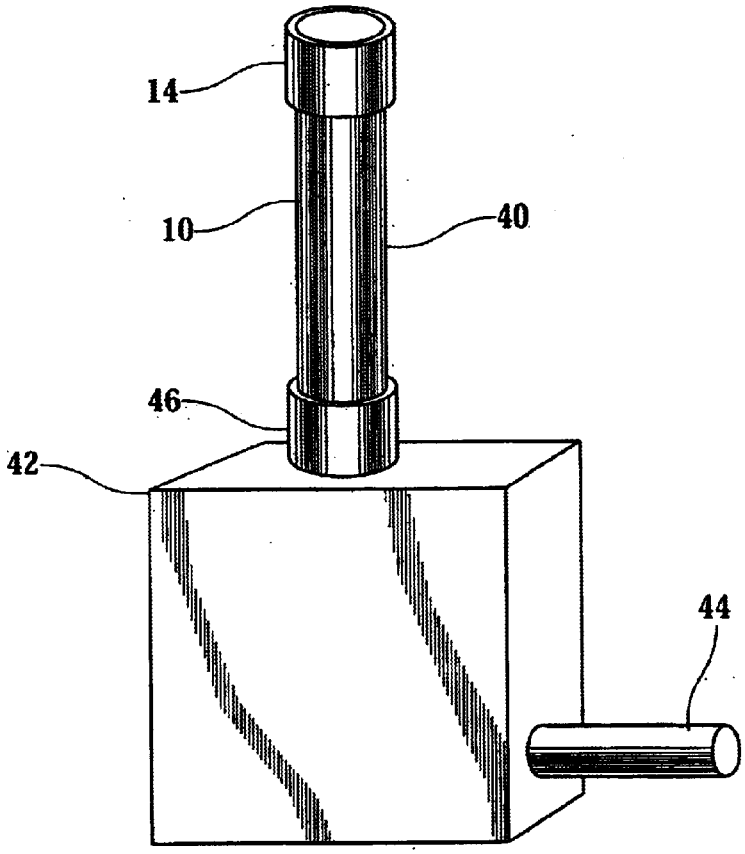
FIG. 6 is an isometric view of a puck shooting device according to one embodiment of the present invention.

FIG. 6 shows a puck shooting device 40 designed for training hockey players, particularly goalies, according to certain embodiments of the present invention. Shooting device 40 comprises a shooter body 42, puck delivery tube 44, and puck receiving tube 46. Shooting device 40 is designed to receive pucks through puck receiving tube 46. Shooting device 40 accelerates each puck to a desired speed within shooter body 42 and expels each puck through puck delivery tube 44. Puck delivery tube 44 is directed to shoot pucks in the direction of one or more hockey players to train them to intercept pucks traveling at high speed.

As shown in FIG. 6, puck receiving tube 46 of puck shooting device 40 is designed to accept puck retrieval device 10 in an inverted orientation. Puck shooting device 40 may be originally manufactured to accept puck retrieval device 10, or may alternately be modified using an adapter suitable for mating to puck retrieval device 10. Operation is similar in either case. In use, shooting device 40 can be most efficiently used in combination with several puck retrieval devices 10. While one puck retrieval device 10 is installed within puck shooting device 40, one or more additional puck retrieval devices 10 can be employed by one or more people on the ice to retrieve the pucks as they are expelled from the puck shooting device 40. With this scheme, a full puck retrieval device 10 can be supplied to immediately replace an empty puck retrieval device 10 as soon as it is emptied of pucks, so that there is no training downtime.

Although puck shooting device 40 is shown accepting puck retrieval device 10 in a substantially vertical orientation, it will be understood by one of skill in the art that puck retrieval device 10 may be disposed at a significant angle from the vertical orientation without departing from the spirit and scope of the present invention. Additionally, although puck shooting device 40 is shown accepting a single puck retrieval device 10, it will be understood by one of skill in the art that alternate embodiments may incorporate the ability to accept two or more puck retrieval devices 10 simultaneously without departing from the spirit and scope of the present invention. In short, there is nothing in the nature of the present invention limiting the applicable inventive concept to the embodiment shown in FIG. 6.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is, therefore, intended that the appended claims encompass any such modifications or embodiments.

What is claimed is:

1. A puck retrieval device comprising:

a puck receiving tube;

a puck retainer, attached to one end of the puck receiving tube and having an inside surface;

a first row of three or more puck retaining whiskers disposed on the inside surface of the puck retainer in a substantially regular pattern; and a second row of three or more puck retaining whiskers disposed on the inside surface of the puck retainer adjacent to the first row in a substantially regular pattern, such that a puck entering the puck retainer will be securely captured by the retaining whiskers;

wherein each retaining whisker comprises a base, a shaft, and tip.

2. The puck retrieval device of claim 1 wherein the tip is shaped to allow the puck to pass the whisker in one direction only.

3. The puck retrieval device of claim 1 wherein the shaft is flexible relative to the base.

4. The puck retrieval device of claim 1 wherein the shaft is rigid relative to the base.

5. The puck retrieval device of claim 1 wherein the whiskers are plastic.

6. A puck shooting device comprising:

a puck shooting mechanism;

a puck receiving tube, removably attached to the puck shooting mechanism in such a manner to feed the puck shooting mechanism with pucks;

a puck retainer, attached to one end of the puck receiving tube and having an inside surface;

a first row of three or more puck retaining whiskers disposed on the inside surface of the puck retainer in a substantially regular pattern; and a second row of three or more puck retaining whiskers disposed on the inside surface of the puck retainer adjacent to the first row in a substantially regular pattern, such that a puck entering the puck retainer will be securely captured by the retaining whiskers;

wherein each retaining whisker comprises a base, a shaft and a tip.

7. The puck shooting device of claim 6 wherein the tip is shaped to allow the puck to pass the whisker in one direction only.

8. The puck shooting device of claim 6 wherein the shaft is flexible relative to the base.

9. The puck shooting device of claim 6 wherein the shaft is rigid relative to the base.

10. The puck shooting device of claim 6 wherein the whiskers are plastic.

* * * * *